United States Patent [19]

Bedenbaugh

[11] 4,369,933

[45] Jan. 25, 1983

[54] YARN TUBE WITH PICKUP GROOVE ACCOMMODATING LEFT HAND AND RIGHT HAND PICKUP

[75] Inventor: William E. Bedenbaugh, Robesonia, Pa.

[73] Assignee: Sonoco Products Company, Hartsville, S.C.

[21] Appl. No.: 224,689

[22] Filed: Jan. 13, 1981

[51] Int. Cl.[3] ..... B65H 75/28

[52] U.S. Cl. ..... 242/125.1; 242/18 PW

[58] Field of Search ..... 242/118.3, 118.32, 118.4, 242/118.7, 125–125.3, 18 PW; 24/73 SA, 73 AP, 73 PB, 115 R; 225/6

[56] References Cited

FOREIGN PATENT DOCUMENTS 14997 of 1906 United Kingdom ..... 242/125.1

*Primary Examiner*—Leonard D. Christian

*Attorney, Agent, or Firm*—Dennison, Meserole, Pollack & Scheiner

[57] ABSTRACT

In a yarn tube having a yarn-supporting surface, a yarn-receiving pickup groove formed in the surface and extending circumferentially at least partially around the tube. The groove, specifically configured to accommodate both right hand and left hand yarn pickup, includes an elongated wide center section to allow proper dropping in and orientation of the yarn from both the right and left. Extending outwardly from both ends of the wide center section are elongated narrow gripping sections which insure a proper snagging of the yarn, initially received within the wide section, regardless of the direction of rotation of the tube. The wide section is of a constant width as are the narrow sections. The entire groove is of a constant depth with the groove in the wide section being of a greater width throughout the height thereof than the width of the groove at the corresponding height in the narrow sections.

7 Claims, 6 Drawing Figures

YARN TUBE WITH PICKUP GROOVE ACCOMMODATING LEFT HAND AND RIGHT HAND PICKUP

RELATED APPLICATION

An application, filed concurrently herewith, Yarn Tube with Universal Pickup Groove, in the name of Manson D. Case, and assigned to the same assignee as the present application, is directed to the environment of the present invention and sets forth distinct solutions to some of the same basic problems presently encountered in the field.

BACKGROUND OF THE INVENTION

This invention relates generally to yarn cores or tubes, and more particularly to the pickup or start-up grooves provided therein.

The term "yarn" is used very broadly in the textile industry to describe long strings of fiber materials, such as Nylon, cotton, fiberglass, polyester, etc. These strings (yarn) are wound on tubes, cones, or the like, as a means for facilitating handling of the yarn when it is moved from one textile process to another. The fully wound tubes are normally referred to as "yarn packages".

In the forming of a yarn package, the tube is placed on a yarn winder spindle which effects high speed rotation of the tube. As the yarn proceeds to the winder and is ready to be wound onto a tube, provision must be made for initial adherence of the leading end of the yarn to the tube. This adherence is normally accomplished by means of a thin slit or groove in the tube surface which, through a wedging action, grips the leading portion of the yarn as it is moved over the groove in the rapidly rotating tube. This action of the groove in gripping the yarn is referred to as a "pickup".

After pickup, the tube continues its high speed rotation with the yarn wrapping therearound in multiple layers which extend along the length of the tube. Wrapping of the yarn in layers along the length of the tube is effected basically by a tube traversing mechanism which guides the yarn back and forth along the length of the rotating tube.

After the initial winding of a few layers about the tube, gripping of the end section of the yarn by the groove is no longer necessary for the tube winding operation itself in that the initial few wraps of yarn provide a sufficient holding force for an effective continuation of the yarn winding operation. However, it is desirable that the groove effectively retain this leading end section of the yarn in that this end needs to be accessible for interconnection to the leading end of a following yarn package in subsequent operations wherein the yarn is fed from successive yarn packages in a continuous manner.

Heretofore, yarn pickup grooves have been designed to pick up a very limited denier range of yarn. In an attempt to increase the range of yarn sizes which can be accommodated by a particular groove, grooves with a wide lead-in section were devised. While such grooves have found wide commercial acceptance, they have one significant drawback in particular, the inability to pick up the yarn in both directions of rotation. Thus, depending on the direction of pickup, the improved grooves are often referred to as right hand grooves or left hand grooves. The U.S. patent to J. M. Heatherly, No. 3,103,305, issued Sept. 10, 1963, refers to a typical single direction tube and specifically illustrates a tube with a right hand groove therein. Basically, looking from the left hand or ungrooved end of the tube in FIG. 1 of Heatherly, the wide section of the groove, that initially receiving the yarn for subsequent gripping within the narrow section, is to the right, thus requiring positioning of the tube on the spindle for rotation toward the right or clockwise, in conjunction with an introduction of the yarn, normally from the right side, in a manner so as to initially engage the wide section of the groove for full, smooth reception therein and subsequent gripping engagement within the following narrow section.

In the actual winding operation, the empty tubes are normally placed in pairs on a winder spindle with the grooved ends of the tubes adjacent each other. This general arrangement, noted in the "prior art" illustration of FIG. 1, provides a convenient means for winding the yarn on a second tube immediately following completion of the first yarn package. Such an arrangement, as will be appreciated from FIG. 1, has heretofore required the adjacent ends of the two tubes to have, respectively, a left hand groove and a right hand groove.

The requirement for tubes with left hand grooves and tubes with right hand grooves, gives rise to obvious inventory problems, In addition, there is a specific need to insure that the tubes have been properly oriented on the spindle for sequential pickup of the yarn on the two tubes.

In some instances, it has been proposed to provide similar grooves adjacent the opposite ends of each tube, providing in effect a right hand groove at one end and a left hand groove at the other end. While such an arrangement would eliminate the necessity of stocking two different types of tubes, additional expense would be involved in the forming of two separate cuts or grooves in a single tube. Further, the problem of a proper orientation of the tubes on the spindles would still exist.

SUMMARY OF THE INVENTION

The present invention proposes a tube pickup groove specifically configured to both incorporate a wide lead-in or drop-in section and also effect yarn pickup regardless of the direction of rotation of the tube or the side from which the yarn is introduced. In other words, the present invention proposes a groove the specific function of which is to accommodate both right hand and left hand introduction of the thread to the tube. No prior art suggestion, insofar as is known, has ever proposed incorporation of the capabilities of both wide drop-in right hand grooves and wide drop-in left hand drooves in a single yarn pickup grooves.

In furtherance of the aims of the present invention, it is proposed that a single right hand-left hand pickup groove be configured to include a constant width and constant depth wide center lead-in or drop-in section terminating, at both ends thereof, in an elongated constant width narrow section. The wide center section allows for proper and substantial "drop" of even heavier denier yarn under conditions of both right hand and left hand introduction with, depending upon the direction of rotation of the tube, one or the other of the narrow sections firmly snagging or gripping the yarn. The narrow sections are contemplated to be of a width capable of accommodating and firmly retaining light denier yarns. In this manner, the proposed groove will, because of the combination of a wide central orientating and guiding receiving-area and a narrow gripping area, accommodate a relatively wide range of yarn with proper gripping of the yarn being achieved regardless of the direction of rotation. The ability of the groove, in both the wide and narrow sections, to accommodate a range of yarn is further enhanced by forming the opposed groove walls in an inwardly converging manner, providing, in cross section, a V-shaped configuration.

Additional objects and advantages may become apparent from the following description of the details of construction and operation of the invention.

In each instance the illustrated size of the grooves has been enlarged for purposes of clarity.

DESCRIPTION OF THE PREFERRED EMBODIMENTS

Figure 1:
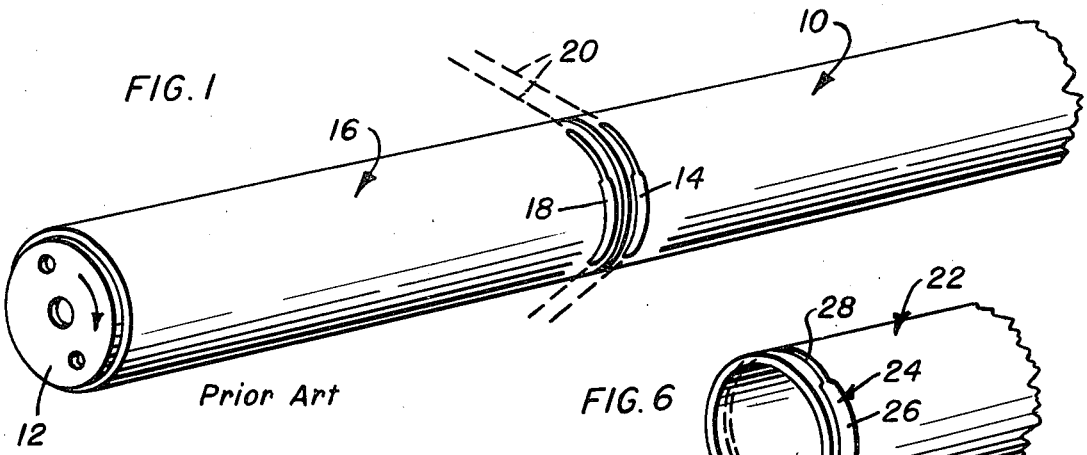
FIG. 1 is a schematic illustration of prior art tubes mounted in operative position on a winding spindle.

Referring now more specifically to the drawings, FIG. 1 illustrates a typical prior art installation wherein the inner tube 10, on a clockwise rotating spindle 12, is provided with a left hand groove 14, and the outer tube 16 is correspondingly provided with a right hand groove 18. In this manner, proper accommodation is made for pickup of the thread 20 when introduced from the right side. As will be recognized, the tubes 10 and 16 must be loaded on the spindle 12 in the specific relationship illustrated if proper pickup is to be achieved. This necessitates not only an inventory of both right and left hand tubes, but also the exercise of a substantial degree of care in positioning the tubes relative to each other on the common spindle.

The present invention, while retaining all of the advantages of the use of a large groove section for initial introduction of the yarn substantially without regard to the thickness thereof, avoids the necessity of two separate sets of tubes and any problems with regard to orientation of the tubes on the spindle.

In furtherance of these aims, the tube of the present invention, herein designated by reference numeral 22, includes a startup or pickup groove 24 specifically configured to fully receive the yarn and effectively snag or grip the yarn regardless of the direction of rotation of the tube. In other words, the tube 22 of the present invention effectively functions both as a "right hand" tube and a "left hand" tube.

Structurally, the groove 24 includes a wide elongated central section 26 terminating, at the opposite ends thereof, in symmetrical elongated narrow end sections 28. It is contemplated that the width of the central section 26 be such as to allow for a "drop" or unencumbered reception of yarn having a wide denier range. Incidentally, in referring to yarn denier, it is to be appreciated that this is a measure of the weight of yarn per unit length. Therefore, higher denier yarns normally are found to be bulkier and larger in diameter. It is the intention of the invention that the central groove section 26 accommodate, orientate and guide a wide range of yarn diameters with the actual snagging or gripping of the yarn occurring in the narrow end sections 28.

Figure 4:
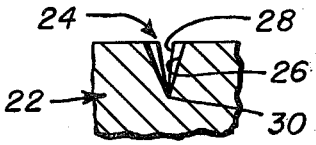
FIG. 4 is an enlarged cross-sectional detail taken substantially on a plane passing along line 4—4 in FIG. 2.

The end sections 28, normally substantially narrower than the center section 26, are of a size to properly and effectively snag and retain any yarn initially received within the center section 26. The ability of the end sections 28 to properly snag the yarn is greatly enhanced by the full "drop" of the yarn, preferably to the bottom of the groove 24, or closely adjacent thereto, as provided for by the wide center section. It is intended that the depth of the groove 24 be constant throughout the length of the sections 26 and 28. Further, as will be appreciated by the cross-sectional detail of FIG. 4, it is also contemplated that the groove 24, in both the wide center section 26 and the narrow end sections 28, be, in transverse cross-section, substantially V-shaped with the opposed walls tapering for the full, or substantially the full, depth or height of the groove to an inner end 30. If so desired, the inward tapering of the opposed groove walls can terminate just short of line contact to provide a flat base at the inner end of the groove 24. However, even in such circumstances, the constant tapering of the walls is extended for substantially the full height of the groove. Throughout the full extent of the tapered height of the groove, the width of the wide center section 26 is greater than the width of the narrow sections 28 at the corresponding height to further insure a proper gripping, in a narrow section, of any yarn received within the wide section.

While, as noted supra, the center section 26 is of a constant width, as are the end sections 28 of a relatively narrower constant width, there is a longitudinally tapering transition area 32 at the opposite ends of the center section whereat the groove 25 changes width. This transition area is relatively short and provides a rapidly converging area through which the yarn moves into snagged engagement with the adjoining narrower end section 28.

The provision of a constant depth throughout the length of the groove 24, in conjunction with a continuous tapering of the groove in cross section, insures proper gripping of any yarn which is capable of dropping or being received within the wider center section 26.

Figure 5:
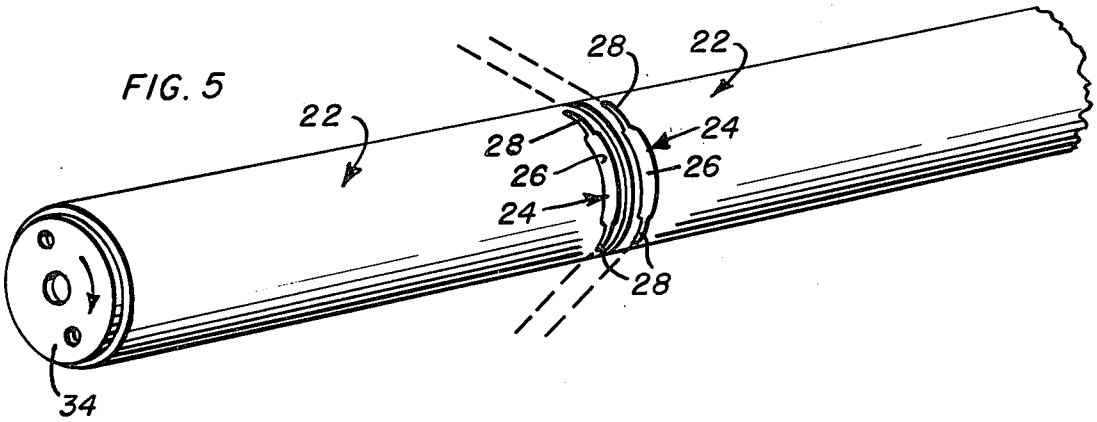
FIG. 5 is a schematic illustration of two tubes formed in accordance with the present invention mounted in operative position on a winding spindle.

The particular significance of the specifically configured groove 24 of the present invention will be appreciated from FIG. 5 wherein two tubes 22, formed in accordance with the present invention, are mounted on a clockwise rotating spindle 34, thus approximating the installation assembly of FIG. 1. However, the tubes 22 are duplicates of each other and require no particular order of installation on the spindle 34 in that the pickup grooves 24, in each instance, automatically provide for right and left hand pickup as required.

While not specifically limited thereto, and only as one example of acceptable groove formation dimensions, the wide center section 26 can have a length of from one inch to $1\frac{1}{2}$ inches and a width at the outer surface of the tube and constant throughout the length thereof, of 1/16 inch to $\frac{1}{8}$ inch. Each of the narrow sections would in turn have a length of from $1\frac{3}{4}$ inches to $2\frac{1}{4}$ inches and a constant width, at the outer surface of the tube, of 1/16 inch or less, but in each instance, substantially less than the width of the wider section 26. It is contemplated that the depth of the groove be constant and from 3/64 inches to 5/64 inches.

Figure 6:
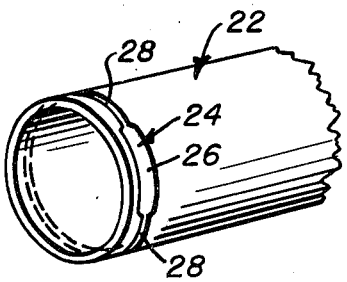
FIG. 6 is a detail of a tube end including a groove variation wherein the narrow gripping sections meet.
Figure 2:
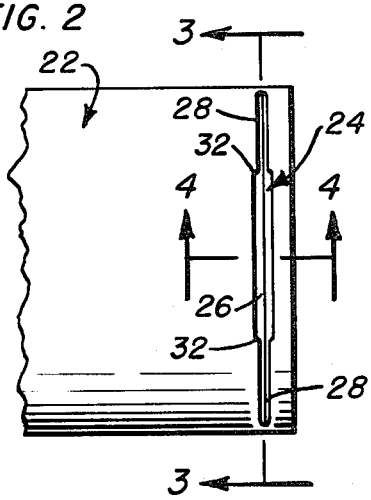
FIG. 2 illustrates one end of a tube grooved in accordance with the present invention.
Figure 3:
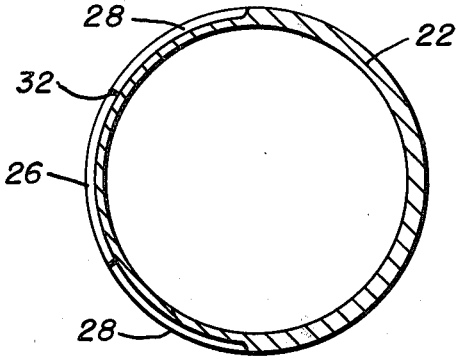
FIG. 3 is a transverse cross-sectional view taken substantially on a plane passing along line 3—3 in FIG. 2.

As a matter of manufacturing expedience, and without affecting the pickup capability of the groove 24, the outer ends of the opposed narrow end sections 28 may meet or join, the groove 24 thus completely encircling the tube 22 as suggested in FIG. 6.

It should also be appreciated that while the groove 24 has been illustrated as occuring adjacent one end of the tube 22, depending upon the particular nature of the yarn winding equipment and/or tubes used, the groove 24 may be positioned at any desired or required location along the length of the tube. It is also to be appreciated that while the tube described and illustrated is of a cylindrical configuration, it is intended that the word tube, as used herein, encompass all forms of yarn winding cores or bodies, including bobbins, cones, and the like.

From the foregoing, it will be appreciated that a significant advance in the art has been defined. Basically, the invention herein provides an effective means for accommodating both right hand and left hand yarn pickup while retaining all of the advantages associated with the provision of a wide elongated "drop-in" area, including the unique ability to accommodate a wide range of yarns limited, at the higher denier ranges, only to a maximum width capable of being accommodated in the "drop-in" section, and at the lower denier ranges to a size which will snag within the substantially narrower gripping area.

The foregoing is illustrative of the principles of the invention. As other variations and embodiments may occur to those skilled in the art, it is to be appreciated that it is not desired to limit the invention to the exact construction and manner of use shown and described. Rather, all suitable modifications and variations may be resorted to, falling within the scope of invention as claimed.

I claim:

1. A yarn tube specifically adapted for rotation in opposed directions and yarn pickup in each opposed direction of rotation; said tube being elongated and having an outer yarn receiving surface, a pickup groove in said tube transverse to the length thereof and through said outer surface for receiving and gripping yarn as the tube is rotated, said groove extending continuously about at least a substantial portion of the circumference of the tube, said groove including an elongated wide center section defining a yarn drop-in area capable of receiving a length of yarn, said center section being of a substantially constant width throughout the length thereof and of a substantially greater length than width, said center section terminating in opposite ends, and a pair of elongated gripping sections extending respectively from the opposite ends of said center section to engage and grip yarn upon a relative movement of the yarn from the center section to one or the other of the gripping sections depending upon the direction of rotation of the tube, said groove being of a generally constant depth throughout substantially the entire length thereof.

2. The yarn tube of claim 1 wherein said gripping sections are each of a substantially constant width throughout the length thereof.

3. The yarn tube of claim 2 wherein said center section, throughout the depth thereof, is of greater width than the width of the gripping sections at a corresponding depth.

4. The yarn tube of claim 3 wherein each of said center section and said gripping sections are of an inwardly tapered configuration in transverse cross-section and terminate in a common inner end.

5. The yarn tube of claim 3 wherein said gripping sections, remote from said center section, meet at a common point to define a groove continuous about said tube.

6. A yarn tube specifically adapted for rotation in opposed directions and yarn pickup in each opposed direction of rotation; said tube being elongated between first and second ends and having an outer yarn receiving surface, a pickup groove in said tube transverse to the length thereof and through said outer surface for receiving and gripping yarn as the tube is rotated, said groove extending continuously about at least a substantial portion of the circumference of the tube, said groove including an elongated wide yarn receiving and orientating drop-in area, and opposed gripping areas, narrower than said drop-in area, communicating with and extending from said drop-in area in opposite directions from said drop-in area for yarn pickup, from said drop-in area, in both directions of rotation of said yarn tube, said groove being of a generally constant depth throughout substantially the entire length thereof.

7. The yarn tube of claim 6 wherein the drop-in area of the groove is tapered in transverse cross-section, of a constant width throughout the length thereof, and of a greater width than the width of the gripping areas throughout the effective depth of the groove.

* * * * *